US009125479B2

(12) United States Patent
Chapuis

(10) Patent No.: US 9,125,479 B2
(45) **Date of Patent: *Sep. 8, 2015**

(54) BACKPACK, SUCH AS A HYDRATION BACKPACK

(71) Applicant: SALOMON S.A.S., Metz-Tessy (FR)

(72) Inventor: Serge Chapuis, Lepin le Lac (FR)

(73) Assignee: SALOMON S.A.S., Metz-Tessy (FR)

( * ) Notice: Subject to any disclaimer, the term of this patent is extended or adjusted under 35 U.S.C. 154(b) by 0 days.

This patent is subject to a terminal disclaimer.

(21) Appl. No.: 14/459,859

(22) Filed: Aug. 14, 2014

(65) Prior Publication Data

US 2014/0353346 A1 Dec. 4, 2014

Related U.S. Application Data

(63) Continuation of application No. 12/794,117, filed on Jun. 4, 2010, now Pat. No. 8,833,619.

(30) Foreign Application Priority Data

Jun. 5, 2009 (FR) ..... 09 02735

(51) Int. Cl.

| | |
|---|---|
| ***A45F 3/04*** | (2006.01) |
| ***A45F 3/14*** | (2006.01) |
| ***A45F 3/16*** | (2006.01) |

(52) U.S. Cl.

CPC ... *A45F 3/16* (2013.01); *A45F 3/04* (2013.01); *A45F 3/14* (2013.01); *A45F 3/047* (2013.01); *A45F 2003/146* (2013.01); *A45F 2003/148* (2013.01); *A45F 2003/166* (2013.01)

(58) Field of Classification Search

CPC ..... A45F 3/04; A45F 3/047; A45F 3/14; A45F 2003/166; A45F 2003/04

USPC ..... 224/148.2, 627, 631, 576, 637, 262, 224/645, 581; 222/175

See application file for complete search history.

(56) References Cited

U.S. PATENT DOCUMENTS

| | | | |
|---|---|---|---|
| 4,948,023 | A | 8/1990 | Tripp |
| 5,400,934 | A | 3/1995 | Ducros |
| 5,803,333 | A | 9/1998 | Fawcett |
| 5,918,785 | A | 7/1999 | Irose |
| 5,975,387 | A | 11/1999 | Gleason et al. |
| 6,098,859 | A | 8/2000 | Bortner |
| 6,220,490 | B1 | 4/2001 | O'Hara |
| 7,175,059 | B2 | 2/2007 | Copich |
| 7,201,299 | B2 | 4/2007 | Forsman |

(Continued)

FOREIGN PATENT DOCUMENTS

| | | |
|---|---|---|
| EP | 1 433 393 A1 | 6/2004 |
| EP | 1 745 719 A2 | 1/2007 |

(Continued)

*Primary Examiner* — Justin Larson

(74) *Attorney, Agent, or Firm* — Greenblum & Bernstein, P.L.C.

(57) ABSTRACT

The invention relates to a backpack including a main rear pocket adapted to receive a load and carrying straps configured to position and maintain the main rear pocket on the user's shoulders, whereby the main rear pocket is formed by the juncture of a first base panel, made of flexible material, adapted to be in contact with the body of the user, and of a second external panel, also made of flexible material, the first base panel being extended at the ends of the main rear pocket to form two closed side loops for passage of the user's arms, forming the carrying straps.

27 Claims, 6 Drawing Sheets

(56) References Cited

U.S. PATENT DOCUMENTS

| | | | | |
|---|---|---|---|---|
| 7,552,734 | B2 | 6/2009 | Adams | |
| 7,568,599 | B2 | 8/2009 | Hall | |
| D603,158 | S * | 11/2009 | Lown et al. | D3/217 |
| 8,083,105 | B2 | 12/2011 | Reichert et al. | |
| 2002/0124294 | A1 | 9/2002 | McKenzie et al. | |
| 2005/0075047 | A1 * | 4/2005 | Zagame | 450/38 |
| 2006/0000856 | A1 * | 1/2006 | West | 224/148.2 |
| 2006/0163305 | A1 | 7/2006 | Tong | |
| 2007/0017947 | A1 | 1/2007 | Fenton et al. | |
| 2007/0029356 | A1 * | 2/2007 | Moriguchi et al. | 224/160 |
| 2007/0051766 | A1 * | 3/2007 | Spencer | 224/607 |
| 2007/0056998 | A1 | 3/2007 | Olson | |
| 2007/0181626 | A1 | 8/2007 | Fenton et al. | |
| 2008/0067202 | A1 * | 3/2008 | Silva et al. | 224/148.2 |
| 2008/0217367 | A1 * | 9/2008 | Lillie | 224/148.2 |

FOREIGN PATENT DOCUMENTS

| | | | |
|---|---|---|---|
| WO | WO 02/087386 | A1 | 11/2002 |
| WO | WO 2005/065481 | A1 | 7/2005 |
| WO | WO 2006/020593 | A1 | 2/2006 |
| WO | WO 2008/048073 | A1 | 4/2008 |

* cited by examiner

Fig.3
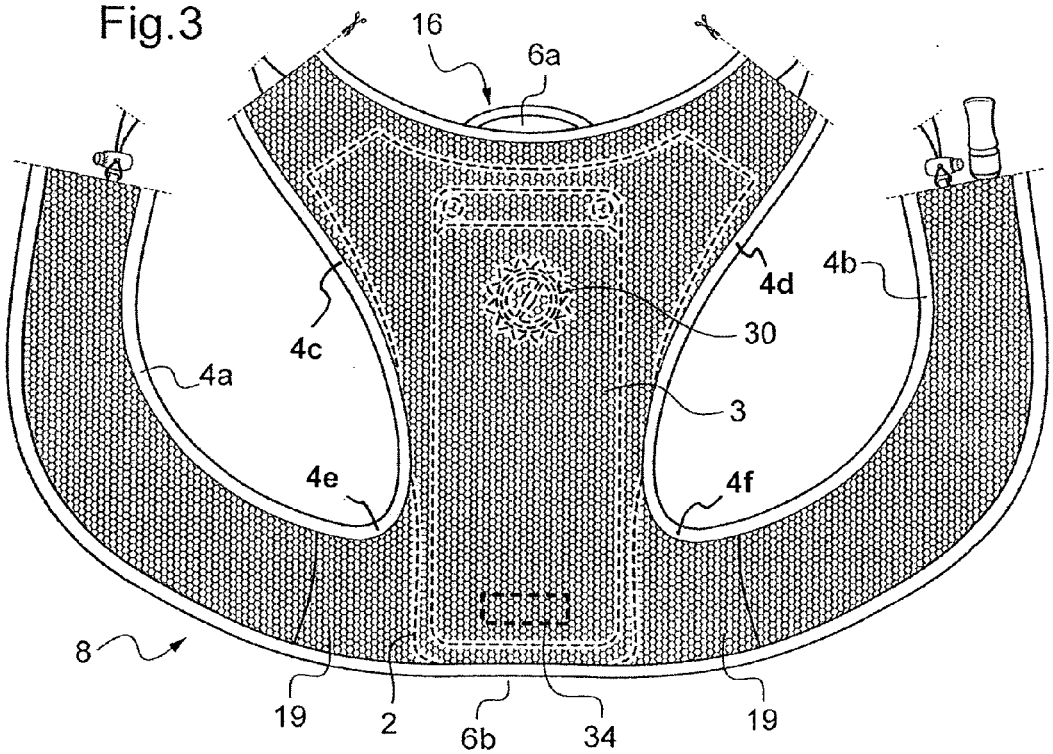
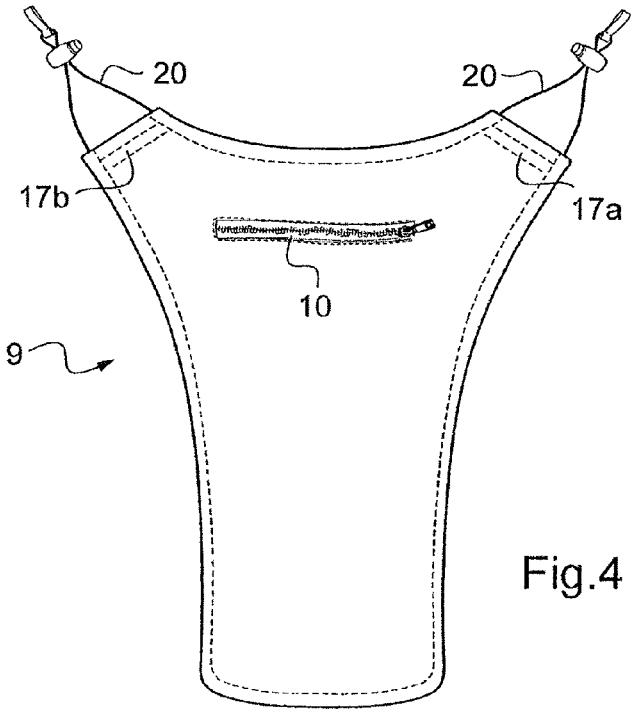
Fig.4

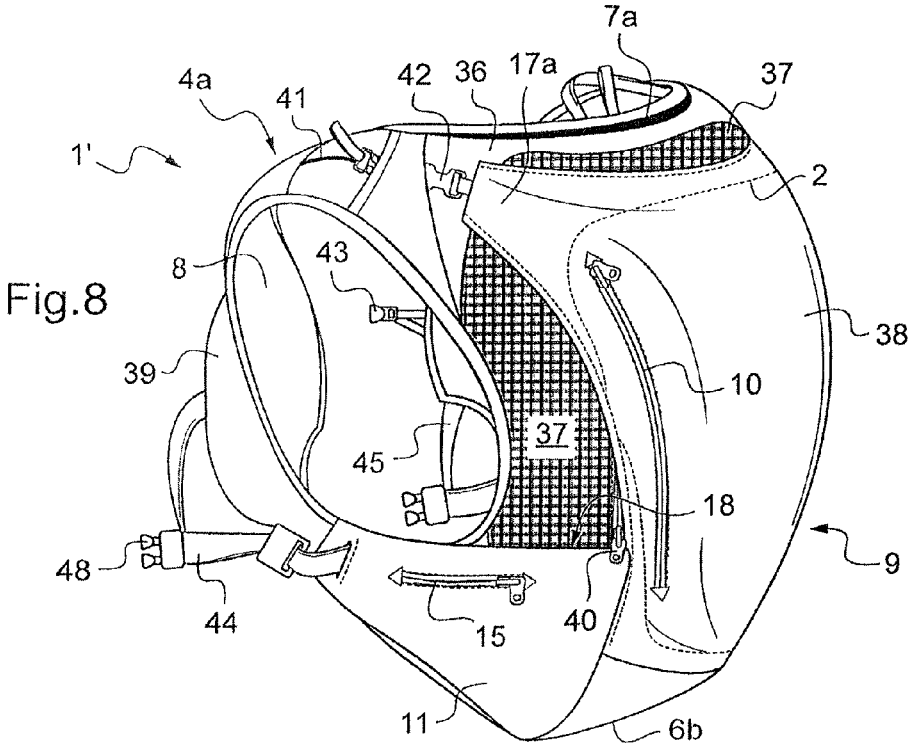
Fig.8
Fig.9
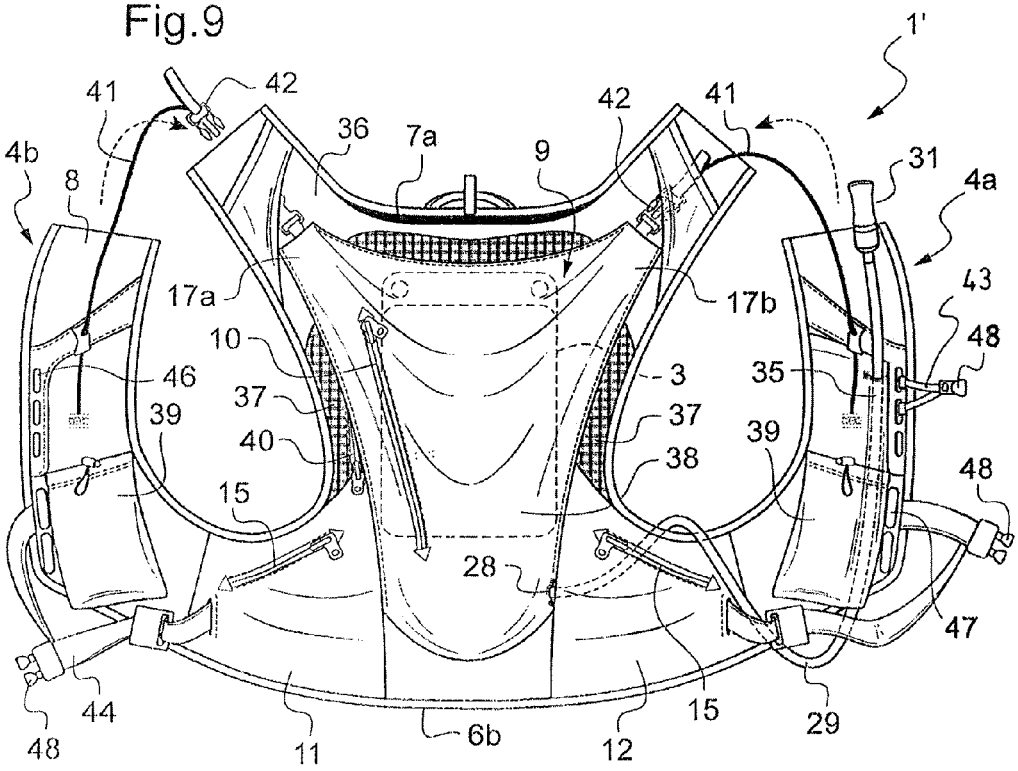

BACKPACK, SUCH AS A HYDRATION BACKPACK

CROSS-REFERENCE TO RELATED APPLICATIONS

This application is a continuation under 35 USC §120 of nonprovisional U.S. patent application Ser. No. 12/794,117, filed Jun. 4, 2010, which claims the benefit under 35 USC §119(a) of French patent application Ser. No. 09/02735, filed Jun. 5, 2009. The disclosures of both of the aforementioned applications are hereby incorporated by reference thereto in their entireties.

BACKGROUND

1. Field of the Invention

The invention relates to a backpack, in particular a hydration backpack, for hiking, for example, such as hiking in the mountains, such backpack being particularly intended for athletes, such as long-distance runners and for those engaged in orienteering.

2. Description of Background and Other Information

Backpacks have been developed in various forms to enable the user to carry loads on his or her back. Such packs are used for walking, traveling, hiking, climbing, cycling races, etc.

Conventionally, a backpack includes a main rear compartment or pocket made of flexible material and attached to a rear portion made of rigid material, the main compartment being adapted to receive a load and possibly capable of being associated with a plurality of interior or external secondary compartments, or pockets.

The main rear compartment forms the backpack body and is maintained in place by two carrying straps. The straps are fixed to the rear portion from which the volume of the main rear compartment extends outward when in a loaded state.

The height adjustment of the backpack can be carried out by varying the length of the carrying straps via keepers and loops while allowing the ends of the carrying straps to remain free and hanging.

These types of backpacks can be used, for example, as hydration backpacks for carrying liquids. Hydration backpacks are designed to facilitate the hydration of the user, i.e., the carrier, during sporting activities, such as cycling, jogging, roller skating, etc. A hydration backpack contains a fluid container, or reservoir, having liquid that the carrier can access by drawing on an end piece attached to a suction tube which extends via an opening at the top of the fluid container. Thus, the carrier can drink the liquid contained in the fluid container on demand.

These types of backpacks, however, are not always optimally ventilated. In particular, the back portion made of a molded rigid material does not allow air circulation between the pack and the carrier's back. This lack of ventilation then promotes perspiration by the user.

Moreover, the back portion made of rigid material is not best adapted to the carrier's morphology, i.e., to the shape of the carrier's back, which can cause discomfort for the user during use, i.e., during exertion.

Furthermore, the load tends to accumulate at the bottom of the main rear compartment, making it difficult to keep the load in place when the user moves around, and can bounce or move laterally on the back of the user.

In addition, the keepers and loops used for the height adjustment of the backpack constitute abrasive portions which can rub and catch on the user's clothing, thus causing them to wear out prematurely.

SUMMARY

The present invention provides an improved backpack which at least partially overcomes the above-mentioned disadvantages, by providing greater comfort and by being adapted to the shape of the user's body, so that it does not cause discomfort, i.e., by allowing a better distribution of the weight of the load and by providing a better evacuation of perspiration between the user's back and the backpack.

To this end, the invention relates to a backpack including a main rear compartment adapted to receive a load and carrying straps configured to position and maintain the main rear compartment on the user's shoulders, the main rear compartment being formed by the joining of a first base panel made of flexible material, adapted to be in contact with the user's body, and of a second external panel also made of flexible material, the first base panel being extended at the ends of the main rear compartment to form two closed side loops for passage of the user's arms, forming the carrying straps.

With the carrying straps being entirely integrated in the first base panel, the backpack fits on the user's back like a waistcoat or a jacket. The carrying straps in the form of closed side loops make it possible to hold the load of the main rear compartment by wrapping it against the user's back. The backpack then adapts to the morphology of the user's body, which allows the user to move more freely. The backpack then follows the movements of the human body, so that the posture and the balance of the body are not affected by the weight of the load.

Moreover, the main rear compartment made entirely of flexible material is such that, when in a loaded state, it becomes deformed against the user's back by promoting air circulation between the pack and the user's back, thus reducing perspiration from the user during exertion.

Moreover, the backpack is less abrasive because the first base panel does not comprise any abrasive element in contact with the user's clothing. Indeed, the carrying straps in the form of closed side loops are continuously formed in the base panel, so that the number of keepers and loops directly in contact with the user's clothing is reduced.

The first base panel can substantially have the general shape of a heart, the indented portion of which is located in the area of a neck from which the carrying straps extend.

The carrying straps can join a back portion of the first base panel, in the area of a lower region, by forming an angle less than 30° with a substantially horizontal straight line. The substantially horizontal projection of the straps allows for a better stability of the load, in particular when the user is racing.

According to an exemplary embodiment, the main rear compartment comprises at least a first compartment and a second compartment, the first compartment of the main rear compartment being formed by the juncture of the first base panel with an intermediate panel of the second external panel, and the second compartment being formed by the juncture of the intermediate panel with a side pocket and a retaining panel of the second external panel, an adjustment mechanism being carried by support arms of the retaining panel.

The second external panel is adjusted on the first base panel, in the area of a zone adapted to be in contact with the user's shoulders, and the backpack further comprises an arrangement to adjust the second external panel on the first base panel in the aforementioned zone. The adjustment arrangement makes it possible to adjust the second external panel on the first base panel depending upon the volume of the load contained in the main rear compartment. Thus, the length of the carrying straps is fixed, but the adjustment arrangement makes it possible to adjust the volume of the load in the user's pack depending upon the load contained in the main rear compartment. Moreover, the adjustment arrangement is arranged on the outer side of the carrying straps and thus does not come in contact with the user's clothing. Moreover, it is arranged in the area of the user's shoulders, so that it can be reached more easily by the user when carrying the backpack. One thus ensures that the volume is properly distributed on the user's back. In the example of a hydration backpack, one thus ensures that the fluid container, even when half-empty, does not remain at the bottom of the user's back.

The first base panel can comprise pleats connected to the second external panel to form the main rear compartment so that, when in a loaded state, the main rear compartment becomes deformed so as to bulge in the direction of the user's back. The main rear pocket entirely made of flexible material is such that, when in a loaded state, the uniformly deformed pocket forms a balanced carrying system that reduces the load carrying stresses on the body, reducing the carrying effort and repositioning the main rear compartment in a more comfortable position on the human body.

The pleats have an elongated shape adapted to align themselves substantially with the user's spinal column, forming side conduits for air evacuation on both sides of the main rear compartment. The main rear compartment can have a shape that is substantially narrowed at its lower end. The shape of the main compartment is then provided to free up space to enable the torso of the body to breathe and avoid perspiration.

The backpack can comprise at least one thoracic strap and/or at least one abdominal strap that is adapted to connect the carrying straps to one another, in the area of the user's torso. At least two straps are advantageously provided, namely an upper strap and a lower strap, spaced apart heightwise on the user's torso to maintain the straps in position and to prevent them from pivoting around the user's arms when the pack is in the loaded state.

According to one embodiment, the carrying straps comprise a first holder strand and a second holder strand, respectively, and each thoracic and/or abdominal strap comprises at least one fastener configured to cooperate with a catch on one of the holder strands, and an adjustment mechanism to adapt the length of the thoracic and/or abdominal straps to the user.

For example, at least one thoracic and/or abdominal strap comprises two points for attachment to a first carrying strap and a sliding fastener configured to cooperate with a catch on a holder strand of the second carrying strap.

The thoracic and/or abdominal straps can thus be attached at various height levels on the user's torso, allowing the possibility of multiple adjustments. Moreover, the thoracic and/or abdominal straps are attached in the area of the holder strands located on the carrying straps, and not on the user's torso, thus avoiding contact with the user's clothing or body. In addition, the fasteners can be attached on the holder strands of either the right or left carrying straps, so that the thoracic and/or abdominal straps can be adjustable for both right-handed and left-handed users.

The adjustment mechanism can be elastic. The mechanism can then have the advantage of being non-abrasive and of facilitating the user's breathing by enabling the thorax to move freely.

According to one or more other characteristics of the backpack, taken alone or in combination,

- the carrying straps have an elastic portion at their junctions with a back portion of the first base panel, in the area of a lower region;
- the first base panel is made of assembled pieces of a three-dimensional fabric configured to evacuate perspiration;
- the backpack further comprises a ventral belt.

According to an exemplary embodiment of a hydration backpack, the connection between the first base panel and the second outer panel has an opening in the area of a lower region for passage of a flexible suction tube extending from a fluid container adapted to be received in the main rear compartment, and at least one of the carrying straps comprises means for guiding the flexible suction tube upward on the carrying strap. The passage of the flexible suction tube beneath the user's arm facilitates its retention and displacement in the positions of use or retraction.

The guiding mechanism can comprise at least one guiding ring.

Alternatively or additionally, the guiding mechanism comprises at least one guiding tunnel.

The invention also encompasses a backpack, such as a backpack for hydration, including a fluid container received in the main rear compartment, the fluid container including a horizontal output port to guide the flexible suction tube toward a carrying strap. One thus avoids having an elbow at the outlet of the fluid container, which can hinder circulation of the liquid and which positions the flexible suction tube directly in line with the carrying strap.

The invention further encompasses a backpack including a rear compartment adapted to receive a load and carrying straps configured to position and maintain the rear compartment on the user's shoulders and back, a fluid container received in the rear compartment and a flexible suction tube connected to the rear compartment by a first end, its second end including an end mouthpiece. The pocket includes an opening positioned in the lower portion of the pack, through which the flexible suction tube passes, and at least one of the carrying straps includes a fan attachment mechanism that enables the attachment of the flexible suction tube to extend from the lower portion of the strap to the top thereof.

That which attaches the flexible suction tube to the strap includes a tunnel.

BRIEF DESCRIPTION OF THE DRAWINGS

Other characteristics and advantages of the invention will be better understood from the description that follows, with reference to the annexed drawings illustrating, by way of non-limiting embodiments, how the invention can be implemented, and in which:

FIG. 3 illustrates a first base panel of the backpack of FIG. 2 during manufacture, in which the parts of the carrying straps are disassembled in an upper region of the pack to show them flat and unfolded;

FIG. 4 shows a second external panel of the backpack of FIG. 2;

FIG. 8 is a ¾ rear view of a hydration backpack according to a second exemplary embodiment;

FIG. 9 is a view, similar to that of FIG. 2, of the backpack of FIG. 8.

DETAILED DESCRIPTION

Figure 1:
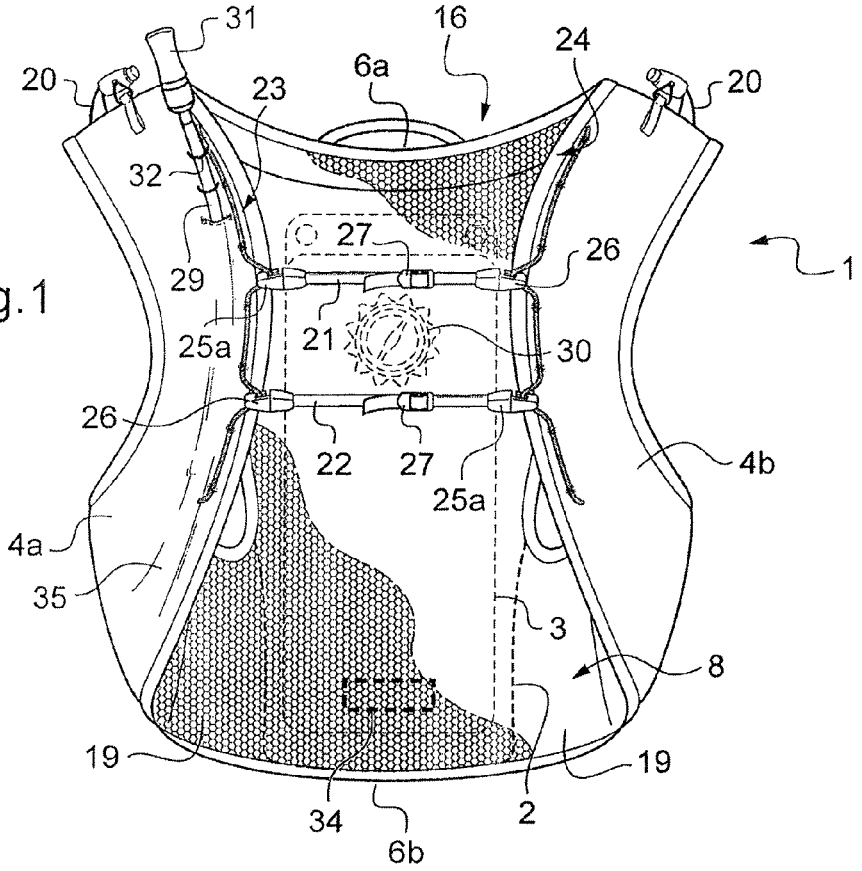
FIG. 1 is a front view of a first exemplary embodiment of a hydration backpack.

In the drawing figures, identical elements bear the same reference numerals. In the following description, the terms upper, lower, high and low, horizontal and vertical are used with reference to the upright position of the user.

FIGS. 1 to 9 show a backpack 1, 1' adapted for hiking, particularly hiking in the countryside or in the mountains, for example, and particularly intended for athletes engaged in long-distance running or orienteering, for example. In the particular non-limiting illustrated embodiments of FIGS. 1 to 9, the backpack 1, 1' is intended for the hydration of an athlete during use of the backpack, i.e., during exertion.

FIGS. 1 to 7 illustrate a first embodiment of a backpack 1, including a main rear compartment or pocket 2 (shown in broken lines in FIGS. 1 and 3) adapted to receive a load, such as foodstuffs, a survival blanket, clothing, or, in this case, a fluid container or reservoir 3.

The main rear pocket 2 can include one or more compartments.

The backpack 1 also includes carrying straps 4*a*, 4*b*, configured to position and maintain the main rear pocket 2 on the shoulders of a user 5.

The backpack 1 further includes a base panel 8 and an external panel 9, further described below. The base panel 8 has two ends 6*a*, 6*b*, i.e., an upper end 6*a* and a lower end 6*b*. The main rear pocket 2 has an opening 7 (see FIG. 2). The opening 7 is horizontal and slightly upwardly concave, for example, and is positioned at the upper end 6*a* of the backpack 1, whereas the lower end 6*b* is closed. An elastic tightening cord can be provided to tighten the opening 7 of the pocket 2 when in the loaded state.

Other embodiments for closing or opening are also possible, such as a vertical opening arranged between the two ends 6*a*, 6*b* and capable of being closed by a fastener, such as a zipper (not shown) or other slide fastener.

The main rear pocket 2 is formed by the joining of a first panel 8 (FIG. 3), i.e., a base panel, made of flexible material, adapted to be in contact with the user's body 4, and a second panel 9 (FIG. 4), i.e., an outer or external panel, also made of flexible material.

The first base panel 8 extends from the ends 6*a*, 6*b* to form two closed side loops for passage of the user's arms, forming carrying straps 4*a*, 4*b*. That is, the straps 4*a*, 4*b* can be considered respective extensions of the first base panel 8, with the two closed side loops including such extensions 4*a*, 4*b* (i.e., straps) and respective sides 4*c*, 4*d* of the base panel 8.

With the carrying straps 4*a*, 4*b* entirely integrated with the first base panel 8, as depicted in FIG. 3, for example, the backpack 1 fits on the back of the user 5 like a waistcoat or vest, or like a jacket. The carrying straps 4*a*, 4*b*, forming the front of the garment-like backpack, make it possible to hold the load of the main rear pocket 2 by wrapping it against the back of the user 5 (see FIG. 5, for example). The backpack 1 then adapts to the morphology of the body of the user 5, which enables the user to move more freely. The backpack 1 thus follows the movements of the human body, so that the posture and balance of the body are not affected by the weight of the load.

Moreover, the main rear pocket 2 made entirely of flexible material is such that, when in a loaded state, it becomes deformed against the back of the user 5 by promoting air circulation between the pack 1 and the carrier's back, reducing perspiration from the carrier during exertion.

Each of the closed or endless side loops is comprised of a plurality of border portions. For example, a first closed side loop comprises the periphery of the first carrying strap 4*a* and that of a portion 4*c* of the base panel 8, and a second closed side loop comprises the periphery of the second carrying strap 4*b* and that of a portion 4*d* of the base panel 8. In addition, such closed side loops are also comprised of respective peripheral borders of the respective ones of the elastic panels 19, the latter being described below. In addition to the backpack 1 comprising the two endless side loops for receiving the arms of the user, the backpack 1 in the illustrated non-limiting embodiment includes, as is evident from the drawing figures, a continuous outer peripheral border that is comprised of the outer peripheries of the carrying straps 4*a*, 4*b* and the upper and lower ends 6*a*, 6*b* of the base panel 8.

In addition to the backpack 1 being flexible to deform against the user's back, the backpack is less abrasive because the first base panel 8 does not comprise any abrasive element in contact with the clothing of the user 5. Indeed, the carrying straps 4*a*, 4*b* are continuously formed with the base panel 8 so that the number of keepers and loops directly in contact with the clothing of the user 5 is reduced. To enable the backpack to adapt to users of various sizes, such as S, M, L, XL, for example, the length of each of the straps can be made adjustable. To this end, each carrying strap can include a first sleeve portion (not shown). The sleeve is arranged in the width of the carrying strap and is configured so that a second portion of the carrying strap can be slipped and maintained therein, in order to reduce or lengthen the length of the carrying strap. The sleeve thus makes it possible to adapt the backpack to the user without creating contact between the keepers or loops and the clothing or body of the user.

The sleeve can be replaced by a mere tongue that would be inserted between adjustment mechanism of a known type (loop, strap, etc.) and the user's body.

The backpack 1 can also include one or more outer, or external, secondary pockets. In the example shown in FIGS. 1 and 2, the hydration backpack 1 thus includes a first secondary pocket 10 in the second panel 9, centered on the main rear pocket 2 (shown in broken lines in FIGS. 2 and 4), to be separate and distinct from the housing of the main rear pocket 2 adapted, for example, to receive a fluid container 3. The backpack 1 further includes a second and a third secondary pocket 11, 12 arranged in the lower areas of the carrying straps 4*a*, 4*b*, respectively, of the pack 1. The openings 13 of the second and third secondary pockets 11, 12, for example, are closed by a magnetic means 14, such as a pair of embedded magnetic strips, or by means of a zipper 15 or other slide fastener.

The first, base panel 8 substantially has the general shape of a heart (FIG. 3), the indented portion 16, or concave portion, being located in the area of the neck from which the carrying straps 4*a*, 4*b* extend.

The first base panel 8 can be formed of assembled pieces, or panels, of a three-dimensional fabric configured to evacuate perspiration. The three-dimensional fabric is made, for example, of honeycombed polyhedral mesh, as shown in the figures of the drawings, or has a wavelet shape forming an alternate succession of hollow and solid rolls. These fabrics make it possible to reduce the surface area in contact with the body or clothing of the user 5 in order to facilitate ventilation and reduce perspiration.

The first base panel 8 comprises a pleated or elastic portion connected to the second external panel 9 to form the main rear pocket 2. The elastic portion or pleats provides more flexibility than the opposite second external panel 9, so that, when in a loaded state (see FIGS. 6*a*, 6*b*), the main rear pocket 2 becomes deformed so as to bulge in the direction of the back of the user 5. The main rear pocket 2 made entirely of flexible material is such that, when in the loaded state, the uniformly deformed pocket 2 forms a balanced carrying system which reduces the load-carrying stresses on the body, reducing the carrying effort and repositioning the main rear pocket 2 in a more comfortable position on the human body.

The second external panel 9, for example, has a shape that is substantially narrowed in the lower area of the pack 1, i.e., at the lower end 6*b*, and retaining arms 17*a*, 17*b* in the upper area (see FIG. 4) on both sides of the indented portion 16 and of the opening 7. The main rear pocket 2 then has elongated pleats adapted to align themselves substantially with the spinal column of the user 5, bulging towards the back of the user in a loaded state, forming side channels 18 for air evacuation on both sides of the main rear pocket 2 (FIG. 6*b*). The shape of the main pocket 2 is then provided to create space to enable the body of the user 5 to breathe and avoid perspiration.

The side channels 18 for air evacuation are demarcated by the pleats connecting the first base panel 8 to the second external panel 9, by the attachment zone of the straps and by the user's body.

Figure 6A:
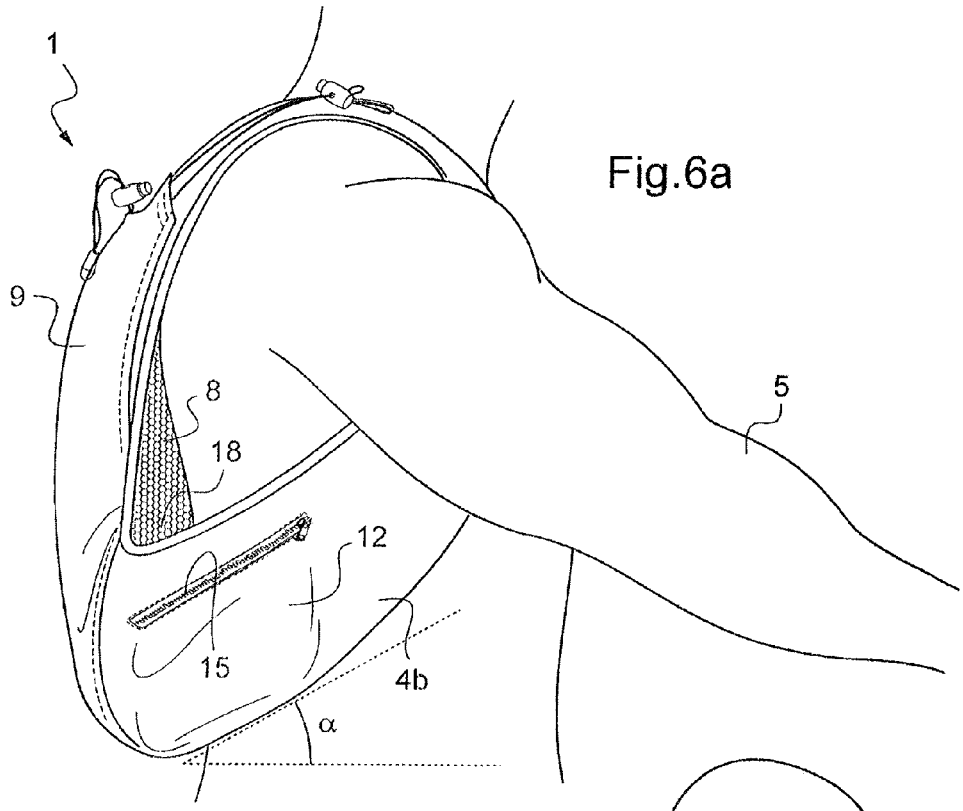
FIG. 6*a* is a side view of the user carrying the backpack of FIG. 5.
Figure 6B:
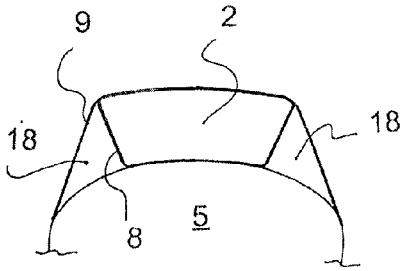
FIG. 6*b* is a cross-sectional schematic view of the backpack of FIG. 5
Figure 7:
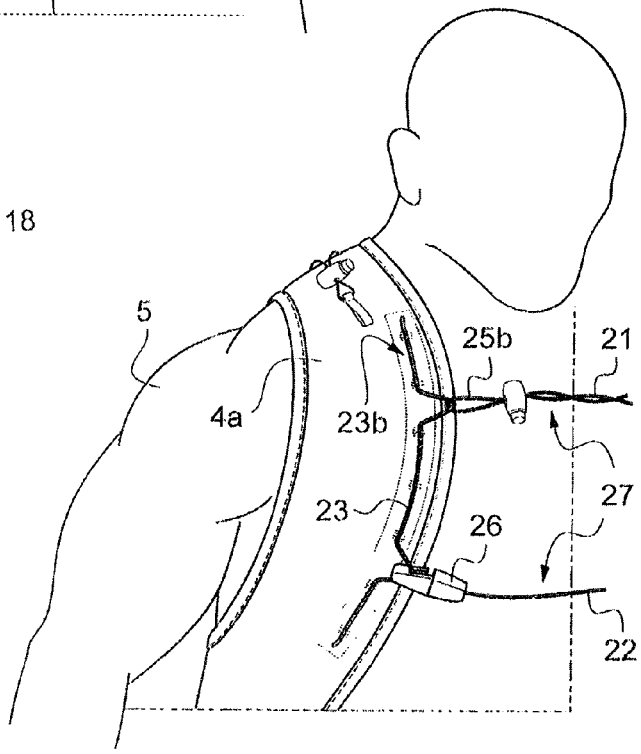
FIG. 7 is a perspective and partial view of the user carrying the backpack of FIG. 5, showing means for adjusting the thoracic straps.

The carrying straps 4*a*, 4*b*, that is, the first and second extensions of the closed side loops 4*a*, 4*b*, connect to a back portion of the first base panel 8 in the area of a lower region, each of the lower edges of each such extension forming an angle $\alpha$ less than 30° with a substantially horizontal straight line, or plane, as depicted in FIG. 6*a*. The substantially horizontal projection of the straps 4*a*, 4*b* allows for better stability of the load, particularly when the user 5 is engaged in a race.

The first base panel 8 can include an elastic portion 19 at its junction, i.e., connection, in the area of a lower region of each attachment of the carrying straps 4*a*, 4*b*, for better adaptation to the body of the user 5. In this regard, see FIG. 3, in particular.

In the illustrated embodiment, the elastic portion 19 fulfills a double function. It ensures a slightly elastic anchoring of the straps 4*a*, 4*b* (which, without the elastic portion 19, the remainders of the straps 4*a*, 4*b*, or the remainders of the extensions of the closed loops 4*a*, 4*b*, might not otherwise be elastic), on the one hand, and it acts as a pleat connecting the first base panel 8 to the second external panel 9, on the other hand, the pleat enabling the pocket to become deformed in the direction of the user's back. The more expanded the pleat is (the more widely spread the elastic portion is), the bulkier the lower portion of the main rear pocket 2 will be, and the more substantial the cross section of the side ventilation channels 18 will be.

The carrying straps 4*a*, 4*b*, for example, have a width ranging between 5 and 12 centimeters (cm) in an upper region of the first base panel 8, and a width ranging between 5 and 15 cm in a lower region of the base panel. The width can also be reduced, for example, by reinforcing the material of the base panel 8.

Flatlock stitching can also be used in assembling the panels 8 and 9, such stitching being covered with protective strips in order to avoid protrusions that could otherwise be a source of abrasion to the wearer's clothing. In this way, any wear that might otherwise be created by the backpack 1 on clothing is avoided.

The second external panel 9 is adjustable on the first base panel 8 in the area of a zone adapted to be in the area of, or in contact with, the shoulders of the user 5. Moreover, the backpack 1 includes an arrangement, i.e., a structure, for the lengthwise adjustment of the second external panel 9 on the first base panel 8 in the aforementioned zone.

The adjustment arrangement is provided on the retaining arms 17*a*, 17*b* in the upper area of the second external panel 9. The mechanism enables the adjustment of the second external panel 9 on the first base panel 8 as a function of the volume of the load contained in the main rear pocket 2. Thus, the length of the carrying straps 4*a*, 4*b* is fixed but the adjustment arrangement makes it possible to adjust the volume of the load on the user's back as a function of the load contained in the main rear pocket 2.

Moreover, the adjustment arrangement is arranged on the outer side of the carrying straps 4*a*, 4*b*, and thus do not come in contact with the clothing of the user 5. Moreover, the adjustment arrangement is arranged in the area of the shoulders of the user 5, so that the user can access the adjustment arrangement more easily when carrying the backpack 1.

Figure 2:
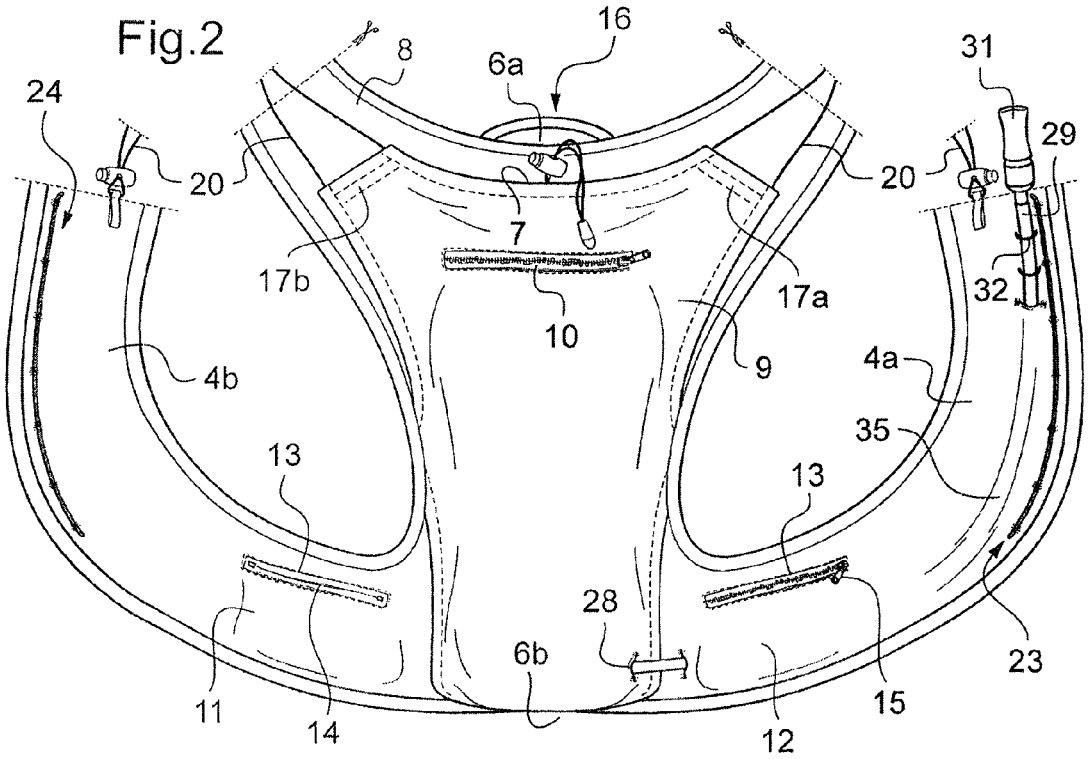
FIG. 2 is a rear view of the hydration backpack of FIG. 1, in which the parts of the carrying straps are disassembled in an upper region of the pack to show the parts flat and unfolded.
Figure 5:
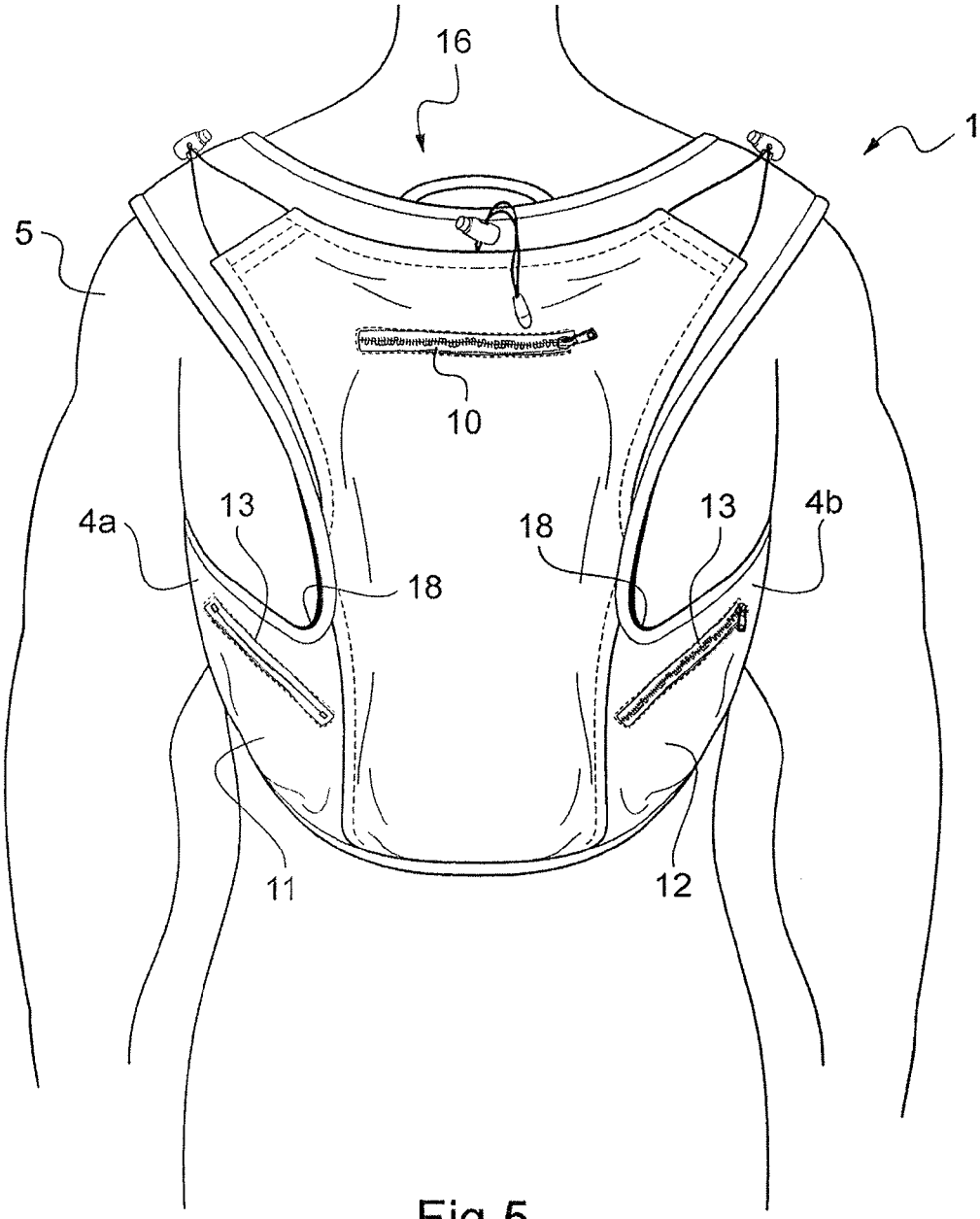
FIG. 5 is a rear view of a user carrying the backpack in a loaded state.

As shown in FIG. 2, the lengthwise adjustment arrangement includes, for example, an elastic cord 20 housed in the upper edges of the second external panel 9, in the area of the retention arms 17*a*, 17*b*. The elastic cord 20, as a manipulatable device of the adjustment arrangement, is arranged so that by pulling on it in the area of each retention arm 17*a*, 17*b*, the entire second external panel 9 is drawn toward the top of the pack 1, thus raising and pressing the load against the first base panel 8.

According to an alternative embodiment not shown, the adjustment arrangement includes two straps connected to one another by an adjustable loop. A first strap is fixed in the upper area of the first base panel 8, on the outer side, and a second strap is fixed at the end of the retention arm corresponding to the second external panel 9, so that, by adjusting the length of the straps of the lengthwise adjustment arrangement, the position of the load in the backpack 1 is adjusted.

The proper distribution of the volume in the back of the user 5 is thereby ensured. In the example of a hydration backpack 1, the fluid container 3, even when half-empty, is ensured not to remain at the bottom of the back of the user 5.

Moreover, to maintain the backpack 1 in position on the shoulders of the user 5 and to prevent it from moving laterally in the back, and to prevent the carrying straps 4*a*, 4*b* from being spaced apart as a function of the volume of the main rear pocket 2, the backpack 1 includes at least one strap adapted to connect the carrying straps 4*a*, 4*b* to one another in the area of the torso of the user 5.

As shown in FIG. 1, two thoracic straps are provided, namely, an upper strap 21 and a lower strap 22, spaced apart heightwise on the torso of the user 5 to maintain the carrying straps 4*a*, 4*b* in position and to prevent them from pivoting around the arms of the user 5 when the backpack 1 is in the loaded state, which is particularly necessary if the carrying straps 4*a*, 4*b* project almost horizontally.

According to the exemplary embodiment shown in FIG. 1, the carrying straps 4*a*, 4*b* include a first holder strand 23 and a second holder strand 24, respectively. Each holder strand 23, 24, for example, is formed by a cord fixed on the corresponding carrying strap 4*a*, 4*b*, by a plurality of points of attachment evenly spaced apart, for example by two centimeters, while leaving some slack on the cord in order to form a plurality of loops, or catches, between the attachment points. In the embodiment shown in FIG. 7, therefore, seven loops on the holder strand 23 are thus provided. The cord can be made, for example, of high-strength fibers, such as Kevlar fibers.

The carrying straps 4*a*, 4*b* can also be provided to have a reinforcement 23*b* (shown in broken lines in the drawing) arranged beneath the holder strips 23, 24. The reinforcement 23*b*, for example, has a small thickness and a width of about 1.5 centimeters in order to be integrated between two assembled pieces of the first base panel 8 and to not hinder the user's comfort.

The reinforcement 23*b* is configured to follow the rounded shape of the carrying strap 4*a*, 4*b*, thus making it possible to reinforce and maintain the carrying straps 4*a*, 4*b* when they are attached to the thoracic straps 21, 22.

Moreover, each thoracic strap 21, 22 is provided with a fastener, such as a hook fastener 25*a* (shown on the upper 21 and lower 22 thoracic straps of FIG. 1) or a loop fastener 25*b* (shown on the upper thoracic strap 21 of FIG. 7), and a hook fastener 26 at the other end of the strap 21, 22. Moreover, the straps 21, 22 are equipped with an adjustment mechanism 27, either elastic (FIG. 7, elastic cord) or with adjustable loop (FIG. 1), to adapt the length of the thoracic straps 21, 22 to the user 5.

The fastener 25*a*, 25*b* cooperates with a loop on the first strand 23 and the hook fastener 26 cooperates with a loop on the second strand 24.

The thoracic straps 21, 22 can thus be attached at various height levels on the torso of the user 5, allowing the possibility of multiple adjustments, i.e., fine adjustments.

Moreover, the thoracic straps 21, 22 are attached in the area of the holder strands 23, 24, located on the carrying straps 4*a*, 4*b*, and not on the torso of the user 5, thus avoiding contact with the clothing or the body of the user 5.

In addition, the hook fasteners 25*a*, 26 are fastener mechanisms that are easy to attach and detach.

Elastic adjustment mechanisms can be found to preferable because they have the advantage of being non-abrasive and of facilitating the user's breathing by allowing the thorax to move freely.

The hook fasteners 25*a*, 26 can be attached on either of the holder strands strips 23, 24 of the right or left carrying straps 4*a*, 4*b*, so that the straps 21, 22 can be adjustable for both right-handed and left-handed users.

Each holder strand 23, 24, for example, is aligned on one end of the carrying straps 4*a*, 4*b*, or can form a zigzag over the width of the carrying strap 4*a*, 4*b* in order to wrap the strap more efficiently and improve its tightening.

The backpack 1 can also include a ventral belt (not shown). The ventral belt would be arranged beneath the lower anchoring zone of the carrying straps 4*a*, 4*b*. It is made of two straps joining one another to be attached after having been placed around the belly of the user 5. According to one embodiment, the ventral belt can include an additional independent pocket. According to another embodiment, the ventral belt can be made in continuity with the first and second panel 8, 9, so that it lengthens the depth of the main rear pocket 2, the closed end of the main rear pocket 2 then being arranged in the lower area of the ventral belt.

A backpack according to the invention can be used, for example, as a hydration backpack for carrying liquids. Hydration backpacks are designed to hydrate the carrier easily during the sporting activity.

For this purpose, the juncture between the first base panel 8 and the second external panel 9, or proximate such juncture, as shown in FIG. 2, has an opening 28 for passage of a flexible suction tube 29 extending from a fluid container 3 adapted to be received in the main rear pocket 2. The container 3 includes at least one filling opening having a relatively large diameter and a closure stopper 30 (visible in see-through in FIG. 3) adapted to close the filling opening. The main rear pocket 2 is then adapted to receive a fluid container 3 having a capacity ranging between 1 to 20 liters, for example.

The flexible suction tube 29 extends from an outlet port 34 of the fluid container 3 to which it is connected, for example via a hydraulic quick coupling (or "quick connect") facilitating the assembly of the flexible suction tube 29 to the fluid container 3, and extends up to a distal end on which an end mouthpiece 31 is assembled. The outlet port 34 of the fluid container 3 is horizontal (either directed to the right, or directed to the left) to guide the flexible suction tube 29 towards the lower portion of the corresponding carrying strap 4*a* or 4*b*, so that the flexible suction tube 29 rises to the upper area of the backpack 1 along the carrying strap 4*a* or 4*b*, under the user's arm. One thus avoids having a bend, or elbow, at the outlet of the fluid container 3, which could hinder the flow of liquid in the flexible suction tube 29. In this regard, as shown in FIGS. 1 and 2, the tube 29 is routed in a direction from the lower end of the container (via outlet port 34 and outlet 28, e.g.) and then upwardly along a front portion of the carrying strap 4*a* or 4*b*, rather than upwardly along the rear-positioned panel 9 of the rear pocket 2. More particularly, in FIG. 1 the tube 29 is shown to exit a forwardly facing outer surface of the carrying strap and leading to the mouthpiece 31. The horizontal outlet port 34 makes it possible to position the flexible suction tube 29 directly in line with the carrying strap 4*a*, 4*b* horizontally or substantially horizontally.

The passage of the flexible suction tube 29 beneath the user's arm also facilitates its retention and its displacement in the positions of use or retraction.

To this end, the carrying straps 4*a*, 4*b* include a structural arrangement to guide the flexible suction tube 29 upward, in order to guide the movement of the flexible suction tube 29 into a position of use or in a position of retraction (see FIGS. 2 and 9), depending upon whether the user pushes it away or pulls it toward him/her.

For example, the guiding arrangement includes a plurality of guiding rings 32, capable of being evenly distributed on the outer edge of the carrying straps 4*a*, 4*b*, to retain and guide the displacement of the flexible suction tube 29 along the carrying strap. A row of guiding rings 32 can thus be arranged on each strap 4*a*, 4*b*, in order to provide the user with the possibility of inserting the suction tube 29 from the right side or from the left side of the backpack 1.

Alternatively or complementarily, the guiding arrangement can include a guiding pathway or conduit 35 to position and guide the displacement of the flexible suction tube 29.

For example, and as is shown in FIGS. 1 and 2, the guiding pathway 35 can be formed by a lining of the carrying strap 4*a*.

According to a second exemplary embodiment, the backpack 1', shown in FIGS. 8 and 9, the main rear pocket 2 includes a first compartment adapted to receive the fluid container 3, for example, and a second compartment adapted to receive foodstuffs or a garment, for example.

In this second exemplary embodiment, the second external panel 9 includes an intermediate panel 36, a side enclosure or pocket 37 and a retaining panel 38 to increase the load capacity of the housing of the main rear pocket 2.

The first compartment of the main rear pocket 2 is formed by the joining of the first base panel 8, adapted to be in contact with the user's body 4, with the intermediate panel 36 of the second external panel 9.

The intermediate panel 36 is attached, such as with stitching, for example, to the base panel 8, on both sides of a first opening 7*a* of the first compartment to form pleats or an elastic portion between the basic panel 8 and the overlying intermediate panel 36, so that, when in a loaded state, the first compartment of the main rear pocket 2 becomes deformed so as to bulge in the direction of the back of the user 5.

The juncture between the first base panel 8 and the second external panel 9 further has an opening (not shown) for passage of a flexible suction tube 29 extending from the fluid container 3 (FIG. 9).

The arrangement to guide the flexible suction tube 29 upward along the carrying strap 4*a* or 4*b* includes, in this example (shown in broken lines in FIG. 9), a guiding pathway 35 including a flexible band having a length of at least 10 cm, for example 15 cm, sewn onto the outside of the carrying strap 4*a* or 4*b*, for example at the rear of each of the third secondary pockets 39. The guiding pathway 35 thus formed retains the flexible suction tube 29 by friction and guides its movement toward the top of the carrying strap. The guiding pathway 35 is further spaced from the opening 28 to enable the flexible suction tube 29 to be placed in a position of retraction, in which the end mouthpiece 31 is away from the user (FIG. 9).

The intermediate panel 36, for example, is sewn to the side pocket 37, and the side pocket 37 is connected to the retaining panel 38 by a closure system 40 in order to reach the second compartment. In this regard, in FIG. 8 the end of a zipper system 40 is shown.

The side pocket 37 and the closure system 40 are three-quarter peripheral, for example, leaving the lower portion of the retaining panel 38 directly connected to the base panel 8, at the end 6*b* of the main rear pocket 2.

The arrangement for adjusting the second external panel 9 on the first base panel 8 is borne by the retention arms 17*a*, 17*b* of the retaining panel 38, in the area of a zone adapted to be in contact with the shoulders of the user 5.

This adjustment arrangement includes a cord 41, the first end of which is anchored to a carrying strap 4*a* or 4*b* of the first base panel 8, and the second end of which is left free so that it can be actuated by the user once the user carries the backpack. The cord 41 can slide around a bar provided, for example, on a snap fastener 42, the orientation or slope of the bar directed by the user, making it possible to allow or block the sliding of the cord 41 in order to adjust the second external panel 9 on the first base panel 8.

When the backpack 1' is carried by the user, the contents of the two compartments can then be adjusted on the user's back depending upon its load. For example, it can be tightened against the user's back when the fluid container 3 is empty, using the adjustment arrangement that is accessible from the front and the retaining panel 38. The retaining panel 38 thus wraps and presses the contents of the second compartment against the first compartment, avoiding any unbalance due to the contents of the main rear pocket 2.

The backpack 1' further comprises a thoracic strap 43 and two abdominal straps 44, 45, adapted to connect the carrying straps 4*a*, 4*b* to one another, respectively, in the area of the torso of the user 5. That is, the straps are designed to be positioned above the area of the hips when the backpack is worn; the straps are not hip straps.

As shown in FIG. 9, the carrying straps 4*a*, 4*b* include a first holder strand 46 and a second holder strand 47, respectively. Each holder strand 46, 47 includes a stem made of plastic, for example, and fixed on the corresponding carrying strap 4*a*, 4*b*, of which a plurality of connecting straps (for example made of flexible bands fixed to the carrying strap) evenly cover the aforementioned stem, so as to form a plurality of free spaces (or catches) of the stem between connecting straps.

Five catches on the holder strip 46, 47, in the example of FIG. 9, are thus provided. The three upper catches, for example, are adapted to cooperate with the fastener of the thoracic strap 43 and the two lower catches, for example, are adapted to cooperate with the fasteners of the abdominal straps 44, 45.

Moreover, the thoracic strap 43 includes two points for anchoring to a first carrying strap 4*a* and a sliding fastener 48 configured to cooperate with a catch on the holder strip 46 of the second carrying strap 4*b*.

The two anchoring points of the strap 43 can be constituted by sliding fasteners that are removably fixed to the catches of the holder strip of the first strap 4*a*. Thus, a left-handed user can reverse the device of the thoracic strap, i.e., position the anchoring points on the second strap and the sliding fastener 48 on the first strap.

The strap 43 comprises an elastic cord, for example, and the sliding fastener 48 comprises a loop provided with a flat hook that can snap fasten on a catch formed by the plastic stem of the holder strip. The elastic cord passes through the loop of the sliding fastener 48 to slide along the latter and thus to adjust the position of the sliding fastener 48 on the elastic cord of the strap 43.

An abdominal strap 44, 45 of the same type is also provided on each carrying strap 4*a*, 4*b*. Each abdominal strap 44, 45 thus comprises two points for attachment to a first carrying strap 4*a*, 4*b* and a sliding fastener 48 configured to cooperate with a catch on the holder strip 46, 47 of the second carrying strap 4*a*, 4*b*.

A first attachment point can be located near the holder strand 46, 47, on the outer edge of the carrying strap 4*a*, 4*b*, whereas the second attachment point is located at the bottom of the user's back, in the area of the end 6*b* of the rear pocket 2, extending around the user's waist.

The hydration backpack 1, 1' can also include an isothermal envelope (not shown) in the main rear pocket 2, adapted to wrap the fluid container 3. The isothermal envelope has an opening for insertion of the fluid container 3 and a hole for passage of the suction tube 29. The isothermal envelope is configured to preform the fluid container 3, so that it closely assumes the shape of the main rear pocket 2. The isothermal envelope also provides thermal protection of the fluid container 3. Moreover, the isothermal envelope facilitates the handling of the fluid container 3 and its positioning in the main rear pocket 2.

The backpacks 1, 1' thus offer increased comfort. They are adapted to the shape of the user's body and do not cause any hindrance for the user by allowing for a better distribution of the weight of the load and a better evacuation of perspiration.

Figure 10:
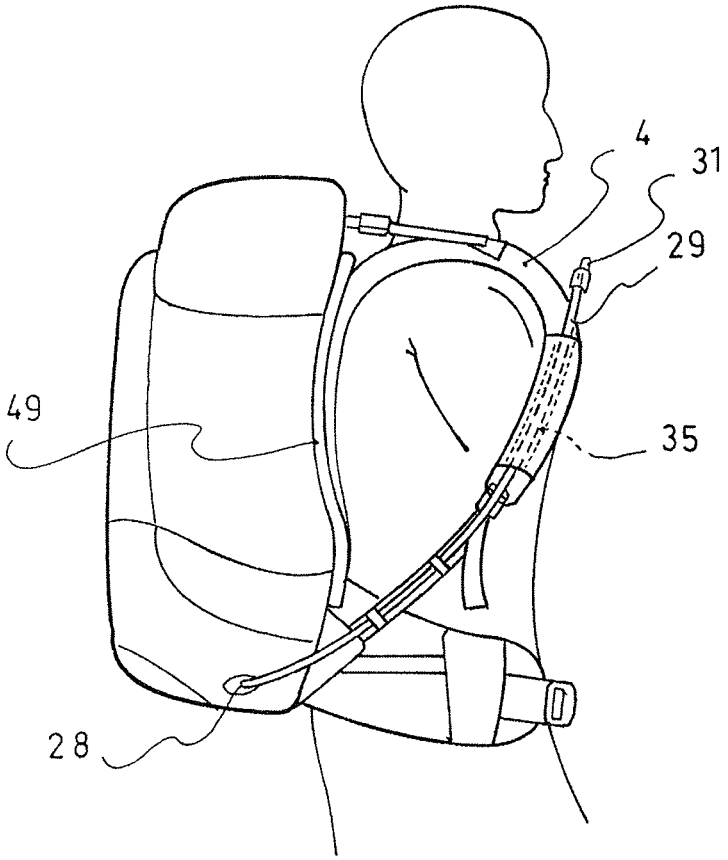
FIG. 10 is a view of a backpack according to a third exemplary embodiment.

FIG. 10 shows a backpack that includes a fluid container housed in an inner pocket (not shown). The backpack includes two carrying straps 4, only one of which is visible in the drawing figure, and a reinforcement 49, which can be rigid or semi-rigid. An opening 28 enables the suction tube 29 to extend into in the lower portion of the backpack. The fluid container is configured so that the suction tube projects therefrom along a horizontal direction. From the opening 28, the suction tube 29 connects to one of the straps, the one being positioned on the same side as the opening 28, by passing beneath the user's arm, i.e., by rising upward from the bottom of the strap. This configuration allows for a shorter travel and a positioning of the end mouthpiece directed upward, therefore directly in the position for suction by the user. In addition, the suction tube is less exposed when it passes beneath the arm than when it passes over the shoulder. For example, because the tube is less exposed to solar radiation, the liquid is less subject to warming. An arrangement for securing the suction tube in place is positioned at various locations along the strap. It includes one or more loops in the lower portion of the strap and a guiding conduit or pathway 35. The pathway 35 makes it possible to wrap the flexible suction tube and to maintain it in a given position by friction. The user can easily determine a suction position in which the user positions the end mouthpiece 31 in order to be able to drink, as well as a position for storing the end mouthpiece 31, in which the user positions the latter in order not to be hindered by the end piece and the tube. The user can also choose a single fixed position for the tube and the end mouthpiece. In this case, the user has to place his/her mouth in the area of the end piece in order to be able to drink.

Lastly, at least because the invention is disclosed herein in a manner that enables one to make and use it to achieve various ones of the characteristics mentioned above in the disclosure of particular exemplary embodiments of the invention, the invention can be practiced in the absence of any additional element or additional structure that is not specifically disclosed herein.

The invention claimed is:

1. A backpack comprising:

a base panel designed to be positioned between a load to be carried and the wearer's back, in a position worn by a user;

an outer panel overlying the base panel to thereby form outer and inner sides of a main rear pocket for receiving the load to be carried;

the base panel having an upper end and a lower end, and the main rear pocket extending at least between the upper and lower ends of the base panel;

first and second closed side loops designed to receive respective ones of first and second arms of the user in the worn position of the backpack;

the first and second closed side loops comprising respective first and second extensions of the base panel, each of the first and second extensions of the base panel extending from a respective one of laterally opposite lower sides of the base panel to a respective one of laterally opposite upper sides of the base panel;

each of the first and second closed side loops comprising a respective elastic portion at a respective one of the opposite lower sides of the base panel, thereby providing the first and second extensions of the base panel with elastic anchoring in relation to the base panel.

2. A backpack according to claim 1, wherein:

in the worn position of the backpack, a lower border of each of the first and second extensions of the base panel extends from a respective one of the laterally opposite lower sides of the base panel at an angle of less than 30 degrees in relation to a substantially horizontal plane.

3. A backpack according to claim 1, wherein:

each of the first and second closed side loops comprises a continuous endless loop, each of the continuous endless loops comprising:

a continuous endless border defined at least in part by the following:

a border portion of the base panel;

a border portion of one of the first and second extensions of the base panel; and a border portion of one of the respective elastic portions.

4. A backpack according to claim 1, wherein:

each of the first and second extensions of the respective first and second closed side loops has a lower edge, extending from respective ones of the opposite lower sides of the base panel, forming an angle less than 30 degrees with a horizontal plane.

5. A backpack according to claim 1, wherein:

respective elastic portions of the first and second side loops have a greater elasticity than respective portions of the first and second extensions of the base panel to which the elastic portions are connected.

6. A backpack according to claim 1, wherein:

each of the first and second extensions of the base panel has a respective lower edge that is directly connected to and extends upwardly from a lowermost edge of the lower end of the base panel less than 30 degrees from a horizontal plane.

7. A backpack according to claim 1, wherein:

each of the first and second closed side loops comprises a continuous endless loop, each of the continuous endless loops comprising:

a continuous endless border defined at least in part by the following:

a border portion of the base panel; and a border portion of one of the first and second extensions of the base panel.

8. A backpack according to claim 7, wherein:

the upper end of the outer panel comprises an upper rear border of the backpack;

the lower end of the outer panel comprises a lower rear border of the backpack; and each of the first and second extensions of the base panel comprises outer peripheral border sections;

the backpack having a continuous outer peripheral border comprising:

the upper rear border;

the lower rear border; and the outer peripheral border sections of the extensions of the base panel.

9. A backpack according to claim 1, wherein:

each of the first and second extensions of the base panel has a respective lower edge that is directly connected to and extends substantially horizontally from a lowermost edge of the lower end of the base panel.

10. A backpack according to claim 9, wherein:

each of the elastic portions is a lower portion of a respective one of the first and second extensions of the base panel.

11. A backpack according to claim 1, wherein:

the outer panel comprises a flexible material; and each of the first and second extensions of the base panel comprises a flexible material.

12. A backpack according to claim 11, wherein:

the base panel, but not the elastic portions of the first and second extensions of the base panel, comprises a three-dimensional fabric.

13. A backpack according to claim 11, wherein:

the elastic portions are more flexible than the outer panel.

14. A backpack according to claim 11, wherein:

the flexible material of the base panel and the flexible material of the extensions of the base panel is the same material.

15. A backpack according to claim 11, wherein:

the flexible material of the base panel and the flexible material of the extensions of the base panel comprise means for conforming the base panel and the extensions of the base panel to a morphology of the user, in the worn position of the backpack.

16. The backpack according to claim 11, wherein:

the elastic portion of each of the first and second extensions of the base panel is configured to provide width-wise expansion for the laterally opposite lower sides of the base panel.

17. A backpack according to claim 11, wherein:

the main rear pocket further comprises first and second laterally opposite gussets, each of the first and second gussets connecting the outer panel to the base panel so that, when the load is in the main rear pocket, the main rear pocket can be deformed into a convex shape toward the back of the user.

18. A backpack according to claim 17, wherein:

the first and second gussets comprise ventilated openings on opposite lateral sides of the main rear pocket and, in a loaded state of the main rear pocket, each of the first and second gussets is designed to be elongated in substantial alignment with the user's spine.

19. A backpack according to claim 17, wherein:

the main rear pocket, at least in a loaded state, has a substantially streamlined tapered shape, a distance between the base panel and the outer panel increasing in a direction toward a lower end of the main rear pocket.

20. A backpack according to claim 17, wherein:

each of the first and second laterally opposite gussets is formed by a part of a respective one of the elastic portions of the first and second extensions of the base panel.

21. A backpack according to claim 1, further comprising:

at least one strap extending substantially horizontally between the first and second closed side loops.

22. A backpack according to claim 21, wherein:

the at least one strap is positioned heightwise spaced from each of the upper and lower ends of the base panel.

23. A backpack according to claim 22, wherein:

the at least one strap is a thoracic strap.

24. A backpack according to claim 21, wherein:

the at least one strap is a lowermost strap having a lower edge spaced heightwise above the lower end of the base panel.

25. A backpack according to claim 24, wherein:

the lowermost strap is a thoracic strap.

26. A backpack according to claim 24, wherein:

the lowermost strap is an abdominal strap.

27. A backpack according to claim 24, wherein:

the lowermost strap is not a hip strap.

* * * * *